US005189992A

United States Patent [19]

Hama et al.

[11] Patent Number: 5,189,992

[45] Date of Patent: Mar. 2, 1993

[54] CYLINDER LINER

[75] Inventors: Fujio Hama; Kenichi Harashina, both of Okaya, Japan

[73] Assignee: Teikoku Piston Ring Co., Ltd., Tokyo, Japan

[21] Appl. No.: 894,474

[22] Filed: Jun. 5, 1992

[30] Foreign Application Priority Data

Jun. 6, 1991 [JP] Japan ..... 3-51056

[51] Int. Cl.[5] ..... F02F 1/10

[52] U.S. Cl. ..... 123/41.84; 123/668

[58] Field of Search ..... 123/41.83, 41.84, 668, 123/193.2

[56] References Cited

U.S. PATENT DOCUMENTS 3,659,569 5/1972 Mayer et al. ..... 123/41.84
3,672,263 6/1972 Mirjanic ..... 123/41.8
4,202,310 5/1980 Zorrilla et al. ..... 123/41.84
4,221,196 9/1980 Castarede ..... 123/41.84
4,640,240 2/1987 Ziegler et al. ..... 123/668
4,794,884 1/1989 Hilker et al. ..... 123/41.79
5,086,733 2/1992 Inoue et al. ..... 123/41.84

*Primary Examiner*—David A. Okonsky

[57] ABSTRACT

A cylinder liner is fitted in a cylinder bore of a cylinder block of a multiple-cylinder engine. The cylinder liner has an outer circumferential surface having a plurality of annular grooves and a plurality of longitudinal grooves connected thereto, in which a cooling liquid is flowed in the grooves. A part in an axial direction of a crankshaft of a bottom of at least one of the annular grooves is coated with a sprayed coating of metal, and a sectional area of the annular groove provided with the sprayed coating varies in a circumferential direction.

10 Claims, 4 Drawing Sheets

CYLINDER LINER

BACKGROUND OF THE INVENTION

1. Field of the Invention

The present invention relates to a cylinder liner for a multiple-cylinder engine.

2. Description of the Related Art

In recent years, it has been known to provide a cooling structure for a cylinder liner flowing cooling liquid in grooves arranged at either one or both of an outer circumferential surface of the cylinder liner and an inner circumferential surface of a cylinder bore in a cylinder block. This is due to the fact that a cooling control can easily be carried out according to positions in the cylinder liner as compared with the jacket type cooling structure applied in the past.

For realizing a proper cooling according to parts in an axial direction of the cylinder liner, for example, Japanese Utility Model Publication No. 3-29560 (Application No. 62-60967) has proposed a cylinder liner formed in its outer circumferential surface with a plurality of groups of annular grooves. The cylinder liner has a plurality of groups of annular grooves at its outer circumferential surface and has longitudinal grooves communicating the annular grooves and forming an outlet and an inlet for a cooling liquid at the surface, wherein the outlet communicates in series with the inlet in adjoining groups of annular grooves and total sectional areas of the annular grooves in the groups of annular grooves are decreased from a lower part toward an upper part.

With the foregoing, a flow of cooling liquid directed from the upper part of the cylinder liner to the lower part thereof will be described, wherein the cooling liquid flows around the outer circumference of the cylinder liner through the annular grooves in a group of annular grooves, thereafter moves from the longitudinal groove forming the outlet of the group of annular grooves toward the longitudinal groove forming the inlet of the adjoining next stage group of annular grooves, flows from the longitudinal groove into the annular grooves of the group of annular grooves, flows around the outer circumference of the cylinder liner, then the cooling liquid is moved to the lower adjoining group of annular grooves in the same manner.

In this case, since the total sectional areas of the annular grooves in the groups of annular grooves are decreased from the lower part toward the upper part in the cylinder liner, a flow speed at the group of annular grooves at the upper part of the cylinder liner is increased, a coefficient of heat-transfer of the cooling liquid at the upper part of the cylinder liner is increased, and a cooling capability at the upper part of the cylinder liner is increased, which performs an appropriate cooling corresponding to a temperature gradient in the axial direction of the cylinder liner (high at the upper part and low at the lower part).

However, even in the case where the cylinder liner with grooves of this kind is used in the multiple-cylinder engine, it has a tendency that parts in directions of major-thrust and minor-thrust tend to be cooled while parts in an axial direction of a crankshaft cannot be sufficiently cooled. Because of this, a temperature distribution in a circumferential direction of the cylinder liner becomes uneven. A temperature difference in the circumferential direction is large in the upper portion of the cylinder liner.

For solving the aforesaid problem, a cylinder liner in which an outer circumferential surface of the cylinder liner has a cylindrical shape, and the bottom of a circumferential groove has an elliptical shape having a long axis which is parallel to an axial direction of a crankshaft and a short axis which is parallel to directions of major-thrust and minor-thrust has been previously proposed in Japanese Patent Laid-open No. 3-78517 publication. This cylinder liner is characterized in that the flow speed of a cooling liquid flowing in the circumferential groove becomes large at the part in the axial direction of the crankshaft and a cooling capacity of said part is large.

However, the cylinder liner of this kind is not uniform in the wall thickness in the circumferential direction to pose two problems that a circularity of the inner circumferential surface of the cylinder liner is hard to obtain, and that cam machining is required to machine a circumferential groove and the production is not easy.

SUMMARY OF THE INVENTION

It is an object of the present invention to provide a cylinder liner in which a temperature in the circumferential direction of the cylinder liner can be made uniform, the circularity of the inner circumferential surface of the cylinder liner is easy to obtain, and the production is also easy.

According to the present invention, there is provided a cylinder liner fitted in a cylinder bore of a cylinder block of a multiple-cylinder engine and having an outer circumferential surface having a plurality of annular grooves and a plurality of longitudinal grooves connected thereto, wherein a part in an axial direction of a crankshaft of a bottom of at least one of the annular grooves is coated with a sprayed coating of metal, a sectional area of the annular groove provided with the sprayed coating varies in a circumferential direction, and a cooling liquid is flowed in the grooves.

By sprayed coating of metal provided at the part in an axial direction of a crankshaft of the bottom of an annular groove of the cylinder liner, a sectional area of a cooling liquid passage at that portion of the annular groove is made to be smaller than other portions. For this reason, the flow speed of the cooling liquid increases, and the coefficient of heat-transfer increases, as a result of which the capacity for cooling the part in the axial direction of the crankshaft increases. As a result, the temperature distribution in the circumferential direction of the cylinder liner becomes uniform.

BRIEF DESCRIPTION OF THE DRAWINGS

The aforesaid and other objects and features of the present invention will become more apparent from the following detailed description and the accompanying drawings.

DESCRIPTION OF THE PREFERRED EMBODIMENT

Cooling liquid grooves are formed at an outer circumferential surface of a cylinder liner in an in-line four oil cooling gasoline engine.

Figure 1:
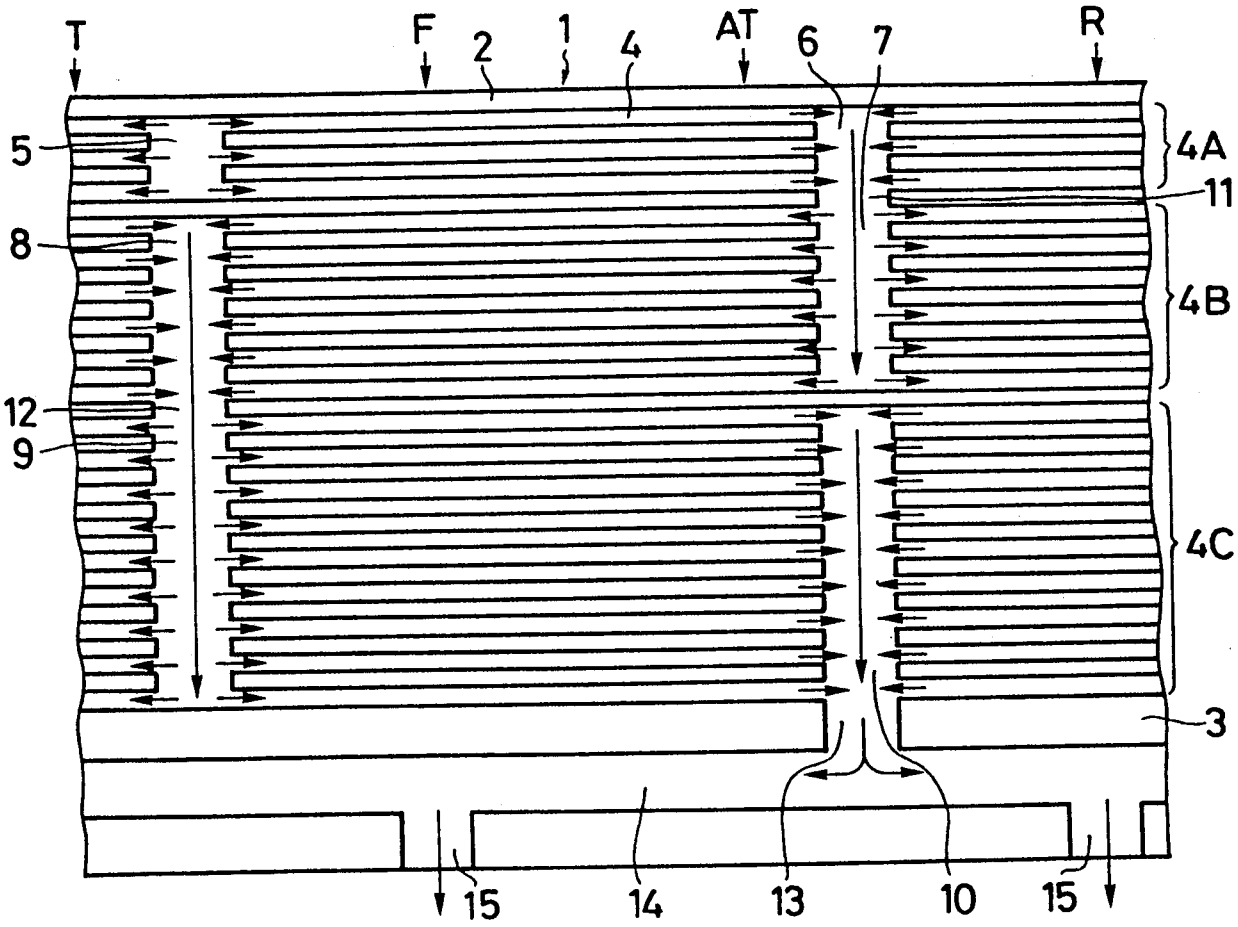
FIG. 1 is a development showing a part of the outer circumferential surface of the cylinder liner according to the present invention.

That is, as shown in FIG. 1, the cylinder liner 1 has a flange 2 at its upper end and an outer circumferential surface 3 of the cylinder liner below the flange 2 is formed with eighteen annular grooves 4 in axially spaced-apart relation. The bottom surface of the annular groove 4, an outer circumferential surface and an inner circumferential surface in the cylinder liner 1 are concentric cylindrical surfaces. These annular grooves 4 are divided into three groups of annular grooves.

The three groups of annular grooves are the first group 4A of annular grooves ranging from the first annular groove 4 at the upper end of the cylinder liner to the third annular groove 4, the second group 4B of annular grooves ranging from the fourth annular groove 4 to the ninth annular groove 4 and the third group 4C of annular grooves ranging from the tenth annular groove 4 to the last or eighteenth annular groove 4.

In the first group 4A of annular grooves, two longitudinal grooves 5 and 6 communicating the annular grooves 4 with each other are provided at two positions spaced apart by 180° in a circumferential direction of the cylinder liner 1, in which one longitudinal groove 5 forms a cooling liquid inlet and the other longitudinal groove 6 forms a cooling liquid outlet. Similarly, in the second group 4B of annular grooves, two longitudinal grooves 7 and 8 communicating the annular grooves 4 with each other are provided at the same two positions in the circumferential direction as the longitudinal grooves 5 and 6 of the first group 4A of annular grooves, in which the longitudinal groove 7 located at the cooling liquid outlet side of the first group 4A of annular grooves forms a cooling liquid inlet and the other longitudinal groove 8 forms a cooling liquid outlet. Also in the third group 4C of annular grooves, two longitudinal grooves 9 and 10 communicating the annular grooves 4 with each other are provided at the same two positions in the circumferential direction as the longitudinal grooves 7 and 8 of the second group 4B of annular grooves in their circumferential directions, in which the longitudinal groove 9 located at the cooling liquid outlet side of the second group 4B of annular grooves forms a cooling liquid inlet and the other longitudinal groove 10 forms a cooling liquid outlet.

The longitudinal groove 6 forming the cooling liquid outlet of the first group 4A of annular grooves and the longitudinal groove 7 forming the cooling liquid inlet of the second group 4B of annular grooves are communicated in series by a longitudinal groove 11 which is located at the same circumferential location as those of said longitudinal grooves 6 and 7 and is formed at the outer circumferential surface of the cylinder liner 1 between the third annular groove 4 and the fourth annular groove 4. In addition, similarly, the longitudinal groove 8 forming the cooling liquid outlet of the second group 4B of annular grooves and the longitudinal groove 9 forming the cooling liquid inlet of the third group 4C of annular grooves are communicated in series by a longitudinal groove 12 which is located at the same circumferential location as those of said longitudinal grooves 8 and 9 and is formed at the outer circumferential surface of the cylinder liner 1 between the ninth annular groove 4 and the tenth annular groove 4.

A lower part of the outer circumferential surface 3 of the cylinder liner is formed with discharging grooves. That is, the discharging grooves are comprised of a longitudinal groove 13 connected to the lower end of the longitudinal groove 10 forming an outlet of the third group 4C of annular grooves and disposed on an extension line of the longitudinal groove 10; an annular groove 14 connected to the lower end of the longitudinal groove 13; and two longitudinal grooves 15 having their upper ends connected to the annular groove 14, extended down to the lower end of the cylinder liner 1. The longitudinal grooves 15 are disposed at locations spaced apart by 180° in their circumferential direction.

These discharging grooves 13, 14 and 15 are formed to use a cooling oil as a cooling liquid and to discharge it into an oil pan. For example, when a cooling water is used as a cooling liquid, the cooling water is flowed out to the discharging passage formed in the cylinder block. It is apparent that in the case of the cooling oil, the oil may be flowed out to the discharging passage in the cylinder block.

In FIGS. 1, 3, 6 and 7, F denotes a front direction, R denotes a rear direction, T denotes a major-thrust direction and AT denotes a minor-thrust direction.

Figure 3:
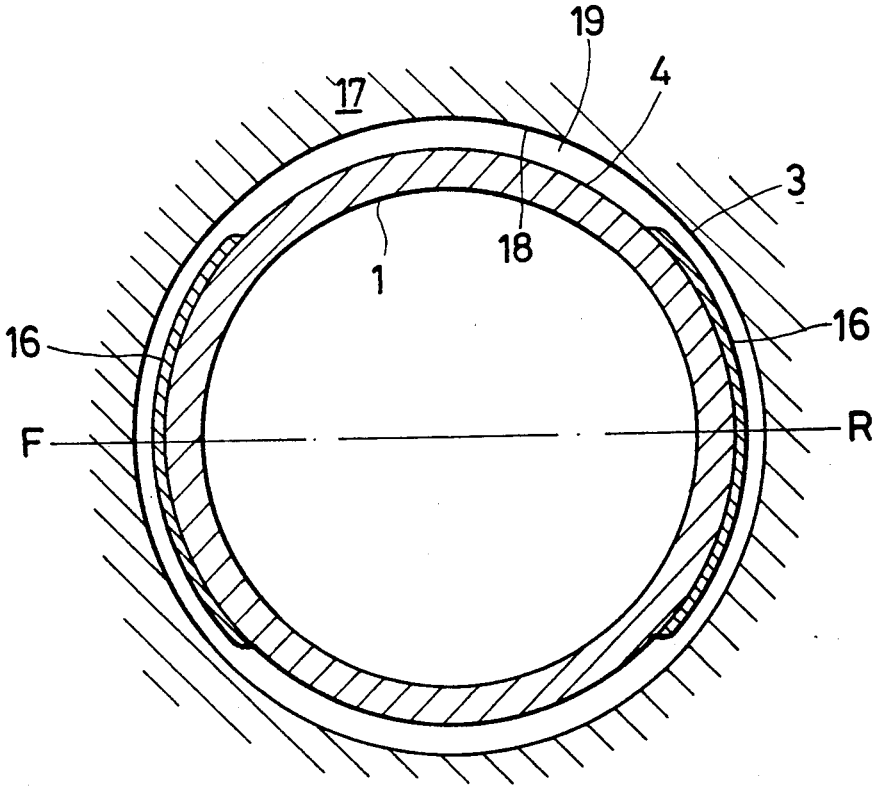
FIG. 3 is a cross-sectional view of an annular groove portion provided with a sprayed coating of metal in the cylinder block in which the cylinder liner according to the present invention is fitted.

As shown in FIG. 3, the bottoms of three annular grooves 4 of the first group 4A of annular grooves of the cylinder liner 1 are coated with a sprayed coating 16 of a copper alloy which is metal having an excellent heat conductivity over the range of ±45 degrees from an axis line of a crankshaft (F-R line in FIG. 3) about a center line of the cylinder liner 1. The sprayed coatings were formed at parts opposed in an axial direction of a crankshaft. Various methods can be employed to apply the sprayed coating over a predetermined range. In the present embodiment, there is employed a method of applying a masking to portions which are not subjected to the sprayed coating.

Main dimensions of the cylinder liner 1 are as follows:

| | |
|---|---|
| Inner diameter | 84 mm |
| Outer diameter | 93 mm |
| Width of an annular groove | 2.5 mm |
| Depth of an annular groove (part in an axial direction of a crankshaft) | 1 mm |
| Depth of an annular groove (part in directions of major-thrust and minor-thrust) | 1.5 mm |
| Width of a longitudinal groove | 20 mm |
| Depth of a longitudinal groove | 1.5 mm |
| Ratio of a sectional area of a cooling liquid passage (part in an axial direction of a crankshaft/part in directions | 0.67 |

-continued of major-thrust and minor-thrust)

Figure 2:
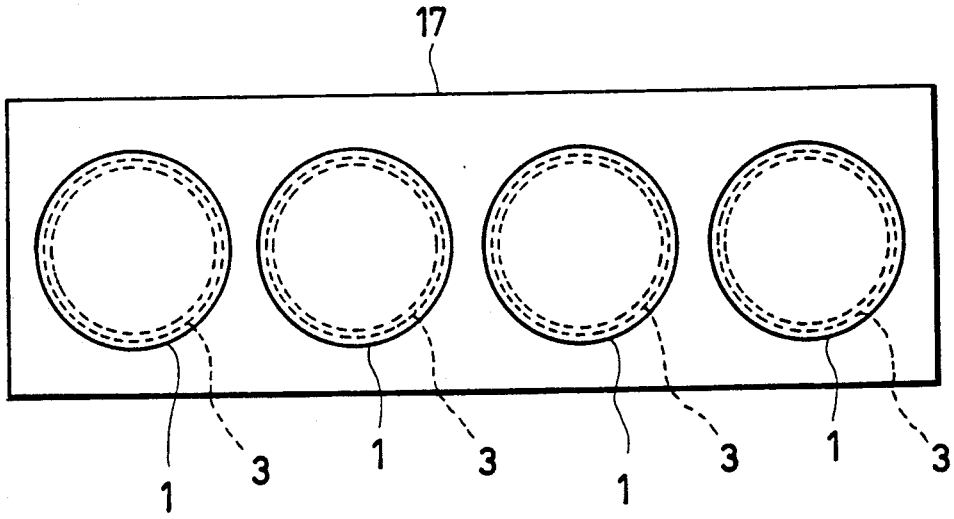
FIG. 2 is a plan view of a cylinder block in which the cylinder liner according to the present invention is fitted.

The cylinder liner 1 is fitted into the bore part of a cylinder block 17 (refer to FIG. 2), and a spacing defined by an inner circumferential surface 18 of the bore part and the grooves 4 to 15 of the cylinder liner 1 serves as a cooling liquid passage 19.

Figure 4:
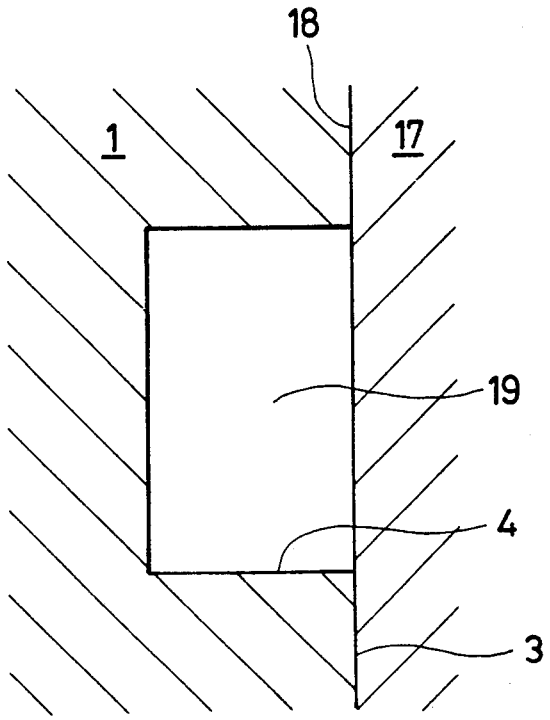
FIG. 4 is a longitudinal sectional view of a part in directions of major-thrust and minor-thrust of the annular groove portion provided with the sprayed coating of metal in the cylinder block in which the cylinder liner according to the present invention is fitted.
Figure 5:
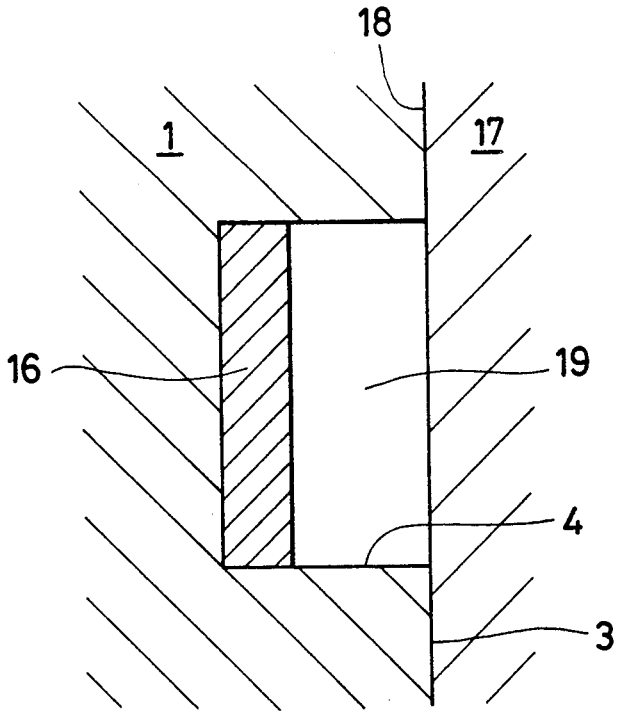
FIG. 5 is a longitudinal sectional view of a part in an axial direction of a crankshaft of the annular groove portion provided with the sprayed coating of metal in the cylinder block in which the cylinder liner according to the present invention is fitted.

In the first group 4A of annular grooves, the sectional area of the cooling liquid passage 19 is not the same in the circumferential direction but the sectional area thereof is large in the part in the directions of major-thrust and minor-thrust (see FIG. 4) and is small in the part in the axial direction of the crankshaft (see FIG. 5). In the second group 4B of annular grooves and the third group 4C of annular grooves, the sectional area of the cooling liquid passage 19 is the same in the circumferential direction.

With the foregoing, a flow of cooling oil will be described, wherein the cooling oil passed through the cooling liquid supplying passage (not shown) formed in the cylinder block 17 and flowed into the longitudinal groove 5 forming the inlet of the first group 4A of annular grooves in the cylinder liner flows in the annular grooves 4 in the first group 4A of annular grooves toward an opposite side of 180° and flows from the longitudinal groove 6 forming the outlet of the first group 4A of annular grooves into the longitudinal groove 7 forming the inlet of the second group 4B of annular grooves.

The cooling oil flows in the annular grooves 4 in the second group 4B of annular grooves toward the opposite side of 180° and flows from the longitudinal groove 8 forming the outlet of the second group 4B of annular grooves into the longitudinal groove 9 forming the inlet of the third group 4C of annular grooves.

The cooling oil flows in the annular grooves 4 in the third group 4C of annular grooves toward the opposite side of 180°, flows from the longitudinal groove 10 forming the outlet of the third group 4C of annular grooves into the longitudinal groove 13 which continues from the longitudinal groove 10, flows into the annular groove 14, flows around the annular groove 14, and drops from the two longitudinal grooves 15 at the lowest end onto the crankshaft not shown, thereafter flows down into the oil pan not shown.

With the foregoing arrangement, the total sectional areas of the annular grooves 4 in the three groups 4A, 4B and 4C of annular grooves are decreased going upwardly, and a flow speed of the cooling oil flowing in each of the groups 4A, 4B and 4C of annular grooves is increased going upwardly.

Accordingly, the coefficient of heat-transfer of the cooling liquid is increased as it goes up to the upper part of the cylinder liner 1, and as a result the cooling capability is increased from a lower part toward an upper part and an appropriate cooling corresponding to the temperature gradient in an axial direction of the cylinder liner is carried out.

Furthermore, according to the present invention, in the first group 4A of annular grooves, the sectional area of the annular groove 4 varies in the circumferential direction, and the sectional area thereof is large in the part in the directions of major-thrust and minor-thrust and is small in the part in the axial direction of the crankshaft. Therefore, the flow speed of cooling oil is small in the part in the directions of major-thrust and minor-thrust and is large in the part in the axial direction of the crankshaft. For this reason, the cooling capacity of the part in the axial direction of the crankshaft is larger than that of the part in the directions of major-thrust and minor-thrust and the temperature in the circumferential direction of the cylinder liner 1 can be made uniform.

Further, in the cylinder liner 1, the inner circumferential surface, the outer circumferential surface 3 and the bottom surface of the annular groove 4 are concentric cylindrical surfaces so that the wall thickness of the cylinder liner is uniform in the circumferential direction and the circularity of the inner circumferential surface is easy to obtain. In addition, since the cam machining is not required, the production is easy.

The in-line four oil cooling gasoline engine is operated under the following conditions, and temperatures of the liner wall at the upper part of the cylinder liner 1 were measured at different positions in the circumferential direction.

Operating conditions of the engine:

| | |
|---|---|
| Engine speed | 3500 rpm |
| Load | 4/4 |
| Flow rate of cooling oil | 281/min |
| Temperature of cooling oil (at an inlet of the cylinder block) | 100° C. |

Figure 6:
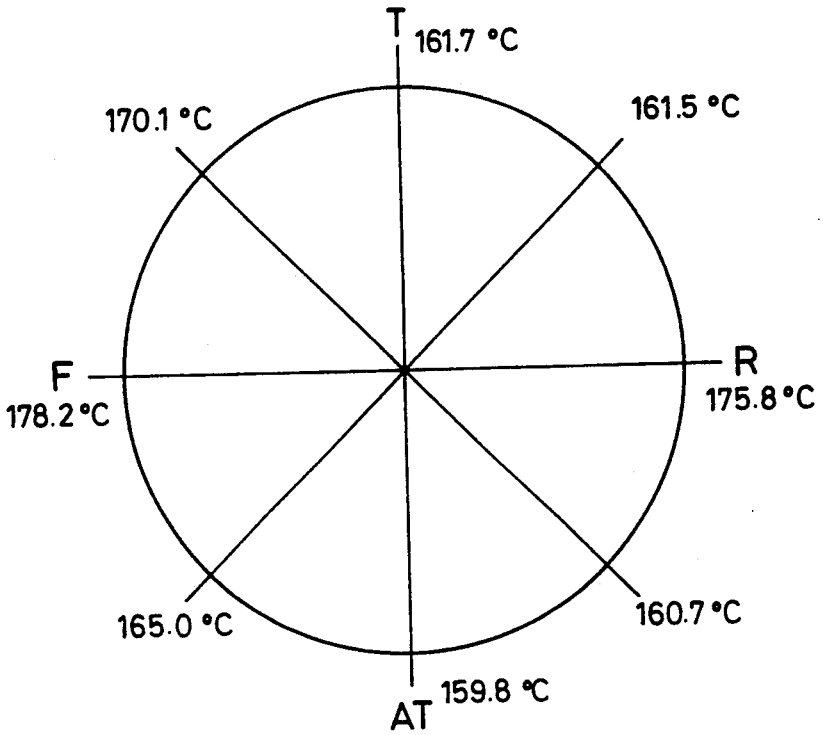
FIG. 6 is a view showing a temperature in a circumferential direction of the cylinder liner according to the present invention.

The wall temperature of the cylinder liner 1 of the third cylinder was as shown in FIG. 6. That is, Part in the axial direction of the crankshaft 178.2° C.–175.8° C.

Part in the directions of major-thrust and minor-thrust 161.7° C.–159.8° C.

Figure 7:
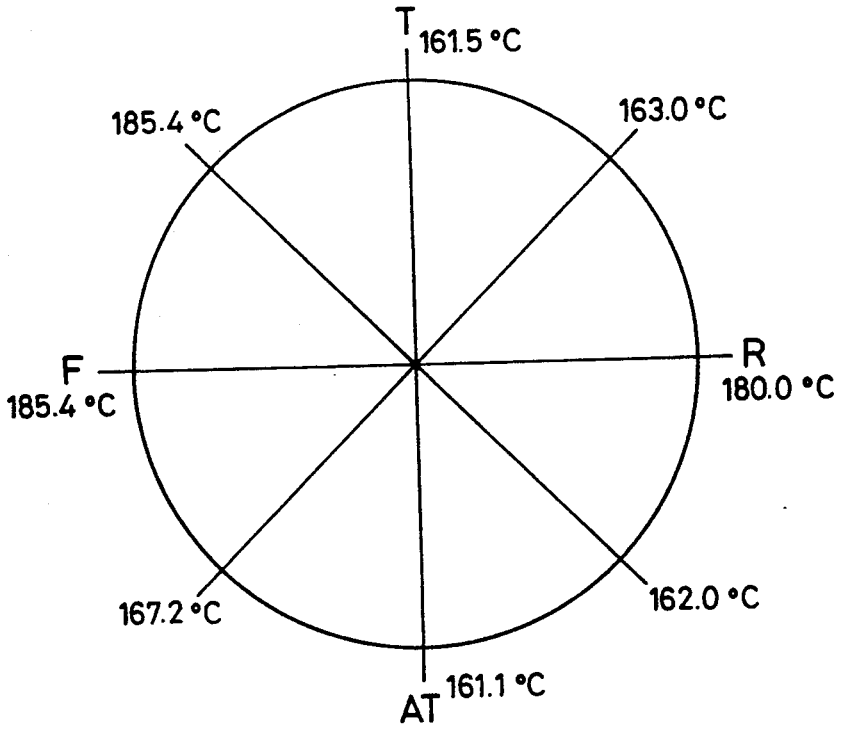
FIG. 7 Prior Art
FIG. 7 is a view showing a temperature in a circumferential direction of a conventional cylinder liner.

For comparison, the temperature in the case of prior art not provided with a sprayed coating was as shown in FIG. 7. That is, Part in the axial direction of the crankshaft 185.4° C.–180.0° C.

Part in the directions of major-thrust and minor-thrust 161.5° C.–161.1° C.

While in the above embodiment, three groups of annular grooves were used, but two or four or more groups of annular grooves may be used. Of course, the structure of the cooling liquid groove applied to the present invention is not limited to that of the aforementioned groups of annular grooves but the structure will suffice to be a structure in which a plurality of annular grooves and longitudinal grooves connected thereto are provided.

While in the aforementioned embodiment, the sprayed coating of metal has been provided in the annular grooves at the upper portion of the cylinder liner, it is to be noted of course that a sprayed coating of metal may be also provided in lower annular grooves.

Furthermore, of course, metal other than copper alloy may be used as metal for the sprayed coating, and metal having a good heat conductivity is preferred.

Sprayed coating is preferably provided in the range of±45 degrees at maximum, at least in the range of±30 degrees from an axis line of a crankshaft about a center line of the cylinder liner.

Moreover, the ratio of the sectional area of the cooling liquid passage at the part in the axial direction of the crankshaft to that of the part in the directions of major-thrust and minor-thrust is preferably in the range of 0.5 to 0.75. When the ratio is smaller than 0.5, a pressure loss of the cooling liquid is excessively large, and a load of a pump for feeding a cooling liquid under pressure disadvantageously increases, whereas when the ratio is larger than 0.75, the part in the axial direction of the crankshaft cannot be sufficiently cooled.

Although in the aforesaid preferred embodiment, the sectional shape of the annular groove is a rectangular one, the present invention is not limited to a rectangular one but it may include a V-shape, a semi-circular one and there is no specific limitation. However, in order to increase a thermal transfer area, a rectangular shape or a square shape is preferable.

Although the present invention has been described with reference to the preferred embodiment, it is apparent that the present invention is not limited to the aforesaid preferred embodiment, but various modifications can be attained without departing from its scope.

What is claimed is:

1. A cylinder liner fitted in a cylinder bore of a cylinder block of a multiple-cylinder engine and having an outer circumferential surface having a plurality of annular grooves and a plurality of longitudinal grooves connected thereto, wherein a part in an axial direction of a crankshaft of a bottom of at least one of said annular grooves is coated with a sprayed coating of metal, a sectional area of said annular groove provided with the sprayed coating varies in a circumferential direction, and a cooling liquid is flowed in said grooves.

2. A cylinder liner fitted in a cylinder bore of a cylinder block of a multiple-cylinder engine and having an outer circumferential surface provided with a plurality of groups of annular grooves, a longitudinal groove communicating the annular grooves with each other and forming an outlet for a cooling liquid in each of said groups of annular grooves, and a longitudinal groove communicating the annular grooves with each other and forming an inlet for the cooling liquid in each of said groups of annular grooves, wherein the outlet communicates in series with the inlet in said adjoining groups of annular grooves, a part in an axial direction of a crankshaft of a bottom of each annular groove of at least one said group of annular grooves is coated with a sprayed coating of metal, a sectional area of said annular groove provided with the sprayed coating varies in a circumferential direction, and a cooling liquid is flowed in said grooves.

3. A cylinder liner according to claim 2 in which total sectional areas of the annular grooves in said groups of annular grooves are decreased from a lower part toward an upper part in an axial direction of the cylinder liner.

4. A cylinder liner according to claim 1, 2 or 3, wherein said sprayed coating is formed at parts opposed in an axial direction of a crankshaft.

5. A cylinder liner according to claim 1, 2 or 3, wherein said sprayed coating is provided in the range of±45 degrees at maximum and at least in the range of±30 degrees from an axis line of a crankshaft about a center line of the cylinder liner.

6. A cylinder liner according to claim 1, 2 or 3, wherein an inner circumferential surface of the cylinder liner, an outer circumferential surface of the cylinder liner and a bottom surface of said annular groove of the cylinder liner are concentric cylindrical surfaces.

7. A cylinder liner according to claim 1, 2 or 3, wherein a ratio of a sectional area of a cooling liquid passage at the part in the axial direction of the crankshaft to that of the part in the directions of major-thrust and minor-thrust is in the range of 0.5 to 0.75.

8. A cylinder liner according to claim 1, 2 or 3, wherein said sprayed coating is formed of metal having a good heat conductivity.

9. A cylinder liner according to claim 8, wherein said metal is a copper alloy.

10. A cylinder liner according to claim 1, 2 or 3, wherein said sprayed coating is provided in an annular groove at the upper portion of the cylinder liner.

* * * * *